US008460121B2

(12) United States Patent
Pinns

(10) Patent No.: US 8,460,121 B2
(45) Date of Patent: Jun. 11, 2013

(54) GOLF PUTTING TRAINING APPARATUS

(76) Inventor: Gary Pinns, Wheaton, IL (US)

( * ) Notice: Subject to any disclaimer, the term of this patent is extended or adjusted under 35 U.S.C. 154(b) by 0 days.

(21) Appl. No.: 13/100,070

(22) Filed: May 3, 2011

(65) Prior Publication Data

US 2011/0269562 A1 Nov. 3, 2011

Related U.S. Application Data

(60) Provisional application No. 61/330,555, filed on May 3, 2010.

(51) Int. Cl.
*A63B 69/36* (2006.01)

(52) U.S. Cl.
USPC ..... 473/227; 473/212; 473/409

(58) Field of Classification Search
USPC ..... 473/201, 206, 212, 213, 214, 219, 473/226, 227, 275, 276, 409
See application file for complete search history.

(56) References Cited

U.S. PATENT DOCUMENTS

| | | | | | |
|---|---|---|---|---|---|
| 5,085,437 | A * | 2/1992 | Leitao | ..... | 473/212 |
| 5,156,401 | A * | 10/1992 | Hodgkiss | ..... | 473/227 |
| 5,203,567 | A * | 4/1993 | Erlinger et al. | ..... | 473/276 |
| 5,248,146 | A * | 9/1993 | Viets et al. | ..... | 473/206 |
| 5,259,621 | A * | 11/1993 | Keefer | ..... | 473/212 |
| 5,711,716 | A * | 1/1998 | O'Brien et al. | ..... | 473/212 |
| 5,904,624 | A * | 5/1999 | Martinez | ..... | 473/212 |
| 7,033,282 | B1 * | 4/2006 | Flood | ..... | 473/227 |
| 7,033,284 | B2 * | 4/2006 | Yoshimura | ..... | 473/276 |

* cited by examiner

*Primary Examiner* — Nini Legesse
(74) *Attorney, Agent, or Firm* — Wood, Phillips, Katz, Clark & Mortimer

(57) ABSTRACT

A putting training apparatus having a frame, a handle on the frame to be gripped by a user to perform a putting stroke, a putter head on the frame for striking a golf ball, and a stabilizer assembly on the frame. The stabilizer assembly is engageable with a user's frontal region with the putting training apparatus operatively positioned to maintain a user's arms braced consistently relative to each other and the handle with the user's hands gripping the handle in a manner to perform a putting stroke.

16 Claims, 6 Drawing Sheets

GOLF PUTTING TRAINING APPARATUS

CROSS-REFERENCE TO RELATED APPLICATIONS

This application is a non-provisional of U.S. Ser. No. 61/330,555, filed May 3, 2010.

BACKGROUND OF THE INVENTION

1. Field of the Invention

This invention relates to the sport of golf and, more particularly, to a training apparatus that can be used to assist the performance of a proper putting stroke. The invention also relates to a method of performing a putting stroke using the putting training apparatus.

2. Background Art

While golf remains popular worldwide, it also remains one of the most frustrating sports for all levels of players; from weekend golfers to tour professionals.

Achieving success in golf depends upon proper and consistent player movement from the full swing to the putting stroke. Professionals strive for this consistency through coaching and repetition that requires long and dedicated practice sessions.

While professional golfers commonly retain full-time coaches, most other golfers cannot afford this luxury. The part-time golfer will typically take lessons periodically and rely upon teaching videos and rudimentary teaching apparatus to develop a proper swing/stroke. There are available training apparatus that do, in fact, assist golfers in improving their golf game. However, ultimate success in the golf game is a result of swing and stroke memory that allows a golfer to consistently use the same proper swing mechanics without excessive "swing thoughts" as a golf ball is being struck.

Since the golf swing is in many respects counterintuitive and unnatural to many, there is often a tendency through repetition to stray from an initially sound swing/stroke platform. Whereas professional coaches may prevent or minimize this problem, the part-time golfer may not even be aware that he/she is progressively detrimentally altering a swing or stroke.

The above problems are particularly vexatious in the area of putting. Part-time golfers often practice putting less than other aspects of the game while, in the end, putting may be the most demanding part of the sport, in terms of the precision and consistency that it requires. Many persons are satisfied so long as they can putt even respectably, which often reduces putting practice to a handful of minutes before rounds. Evidence of this can be seen at any golf course on which putting styles are often as numerous as the players that populate the courses.

One reason putting is often neglected by part-time golfers is that golfers rarely understand the mechanics of a proper putting stroke. As a result, they do not consistently putt such that repetition builds in muscle memory that translates into consistency.

Putting training apparatus are available in many forms on the market. Generally, these existing apparatus do not confine the user in a manner that the proper putting stroke can be sensed and consistently replicated. The absence of an effective putting training apparatus highlights the difficulty of designing the same, particularly since there is such an emphasis on developing golf products of this type worldwide. Few audiences are more receptive to training devices that will assist performance than those in the golf arena. An effective golf training device would be welcome not only by the part-time golfer but the highest caliber of professional.

The industry continues to seek out golf training apparatus that would allow a player to sense the proper stroke mechanics for a putt and repeat the same without significant confinement of movement during practice.

SUMMARY OF THE INVENTION

In one form, the invention is directed to a putting training apparatus having a frame, a handle on the frame to be gripped by a user to perform a putting stroke, a putter head on the frame for striking a golf ball, and a stabilizer assembly on the frame. The stabilizer assembly is engageable with a user's frontal region with the putting training aid operative positioned to maintain a user's arms braced consistently relative to each other and the handle with the user's hands gripping the handle in a manner to perform a putting stroke.

In one form, the frame includes a golf putter having an elongate shaft extending between the handle and the putter head.

In one form, the stabilizer assembly has first and second spaced arm supports to engage, one each, with a user's arms extended to perform a putting stroke.

In one form, the first and second arm supports have first and second oppositely opening U-shaped seats against which a user's arms can be placed with the user's arms situated to perform a putting stroke.

In one form, the stabilizer assembly has an elongate member that continuously spans across a user's arms and defines spaced regions against which a user's arms can be placed with the user's arms situated to perform a putting stroke.

In one form, the first and second arm supports each includes a closed loop.

In one form, each of the closed loops has a selectively variable diameter.

In one form, the first and second arm supports have a selectively variable spacing, each from the other.

In one form, the golf putter and stabilizer assembly are interconnected so that a spacing between the handle and stabilizer assembly can be selectively changed.

In one form, the elongate shaft has an axis and the golf putter and stabilizer assembly are interconnected so that the elongate shaft can be turned around the elongate shaft axis relative to the stabilizer assembly.

In one form, the golf putter and stabilizer assembly are interconnected so that the stabilizer assembly can be turned guidingly relative to the golf putter around an axis.

In one form, the stabilizer assembly has a vertical base and an elongate member that defines spaced regions against which a user's arms can be placed with the user's arms situated to perform a putting stroke and the vertical base and elongate member together define a "T" shape.

In one form, the stabilizer assembly is configured to engage a user's upper arms with the putter training apparatus operatively positioned.

In one form, the stabilizer assembly is configured to engage a user's forearms with the putting training apparatus operatively positioned.

In one form, the invention is directed to a putting training apparatus having a frame, a handle on the frame to be gripped by a user to perform a putting stroke, and a stabilizer assembly on the frame that is engageable with a user's frontal region with the putting training aid operatively positioned to maintain a user's arms braced consistently relative to each other and the handle with the user's hands gripping the handle in a manner to perform a putting stroke.

In one form, the invention is directed to a method of performing a putting stroke. The method includes the steps of: providing a putting training apparatus as in claim 1; grasping the handle in a manner to perform a putting stroke; engaging the stabilizer assembly with the user's frontal region so that the stabilizer assembly is borne against both of the user's arms to allow a braced triangle to be maintained by the user defined by: a) the user's arms converging towards each other at the handle; and b) the user's torso at the user's frontal region; and through the handle repositioning the putter head to perform a putting stroke while maintaining the braced triangle.

In one form, the step of engaging the stabilizer assembly involves engaging the stabilizer assembly with each of the user's forearms.

In one form, the step of engaging the stabilizer assembly involves engaging the stabilizer assembly with each of the user's arms at upper regions thereon.

In one form, the method further involves the step of changing a spacing between the handle and the stabilizer assembly.

In one form, the method further includes the step of changing a relationship between the stabilizer assembly and putter head.

DETAILED DESCRIPTION OF THE PREFERRED EMBODIMENT

Figure 1:
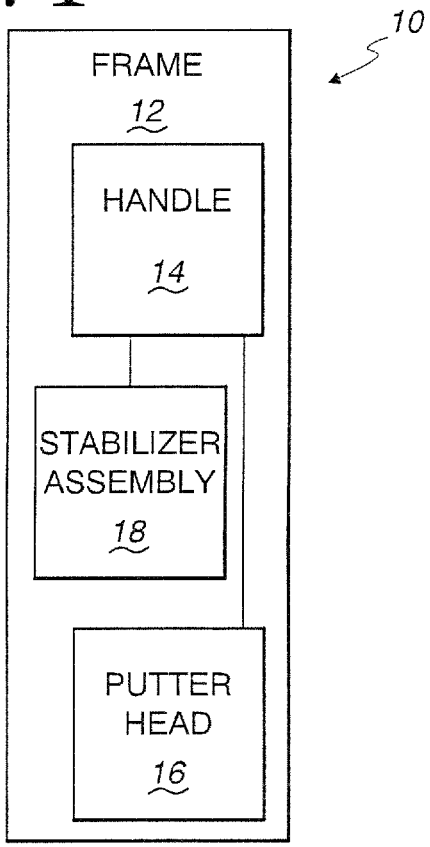
FIG. 1 is a schematic representation of one form of putting training apparatus according to the present invention.

Referring initially to FIG. 1, a putting training apparatus, according to the present invention, is shown schematically at 10. The putting training apparatus has a frame 12. A handle 14 on the frame 12 is configured to be gripped by a user to perform a putting stroke. A putter head 16 on the frame 12 is used for striking a golf ball. A stabilizer assembly 18 on the frame 12 is engageable with a user's frontal region, with the putting training apparatus 10 operatively positioned, to maintain the user's arms braced consistently relative to each other and the handle 14 with the user's hands gripping the handle 12 in a manner to perform a putting stroke.

The depiction of the putting training apparatus 10 in schematic form is intended to generically encompass virtually a limitless number of variations from the specific forms described hereinbelow. The putting training apparatus 10 might be made by incorporating a conventional putter having the handle 14 and putter head 16 joined by a shaft. Alternatively, the overall structure can be made to simulate the putter components without requiring a functional version thereof.

Figure 2:
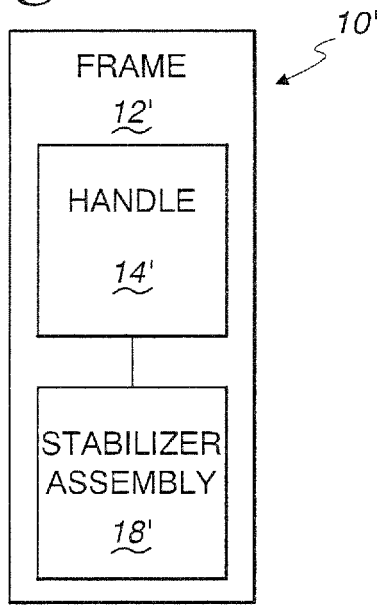
FIG. 2 is a schematic representation of a modified form of putting training apparatus according to the invention.

A modified form of putting training apparatus is shown at 10' in FIG. 2 with a frame 12' and a handle 14' and stabilizer assembly 18', corresponding to those like numbered components in FIG. 1. The primary distinction between the training apparatus 10' and that shown at 10 in FIG. 1 is that the putting training apparatus 10' does not require a putter head or a simulation thereof. Instead, the putting training apparatus 10' can be used to practice a stroke without actually striking a golf ball.

One specific form of the putting training apparatus 10 is shown in FIGS. 3-7. In this embodiment, the putting training apparatus 10 incorporates an off-the-shelf putter 20 with the aforementioned putter head 16, handle 14, and an elongate shaft 22 therebetween.

The frame 12 is made up of the putter 20 and the stabilizer assembly 18 joined thereto.

Figure 3:
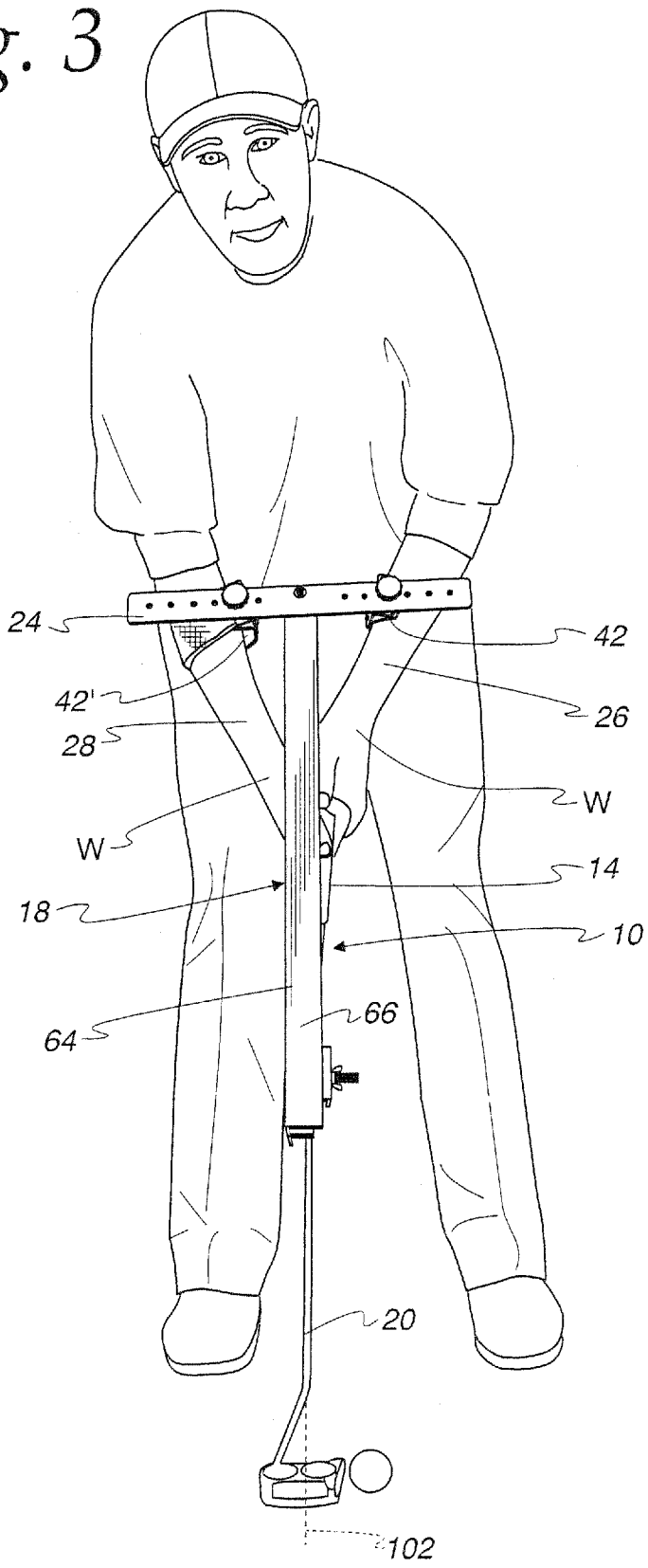
FIG. 3 is a front elevation view of one specific form of putting training apparatus, as shown schematically in FIG. 1 and with the putting training apparatus operatively positioned relative to a user.
Figure 4:
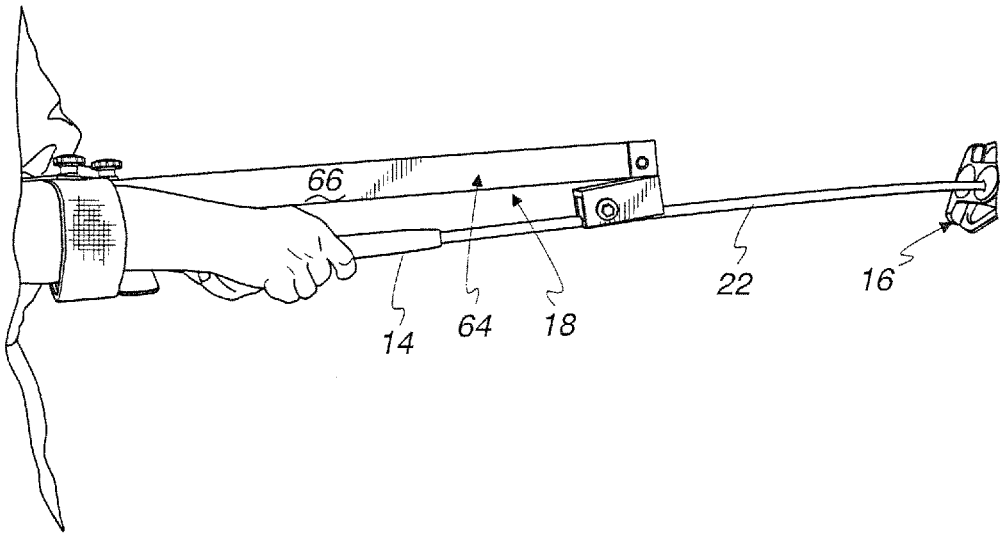
FIG. 4 is a side elevation view of the operatively positioned putting training apparatus in FIG. 3 and with the associated putter elevated by the user's arms.
Figure 5:
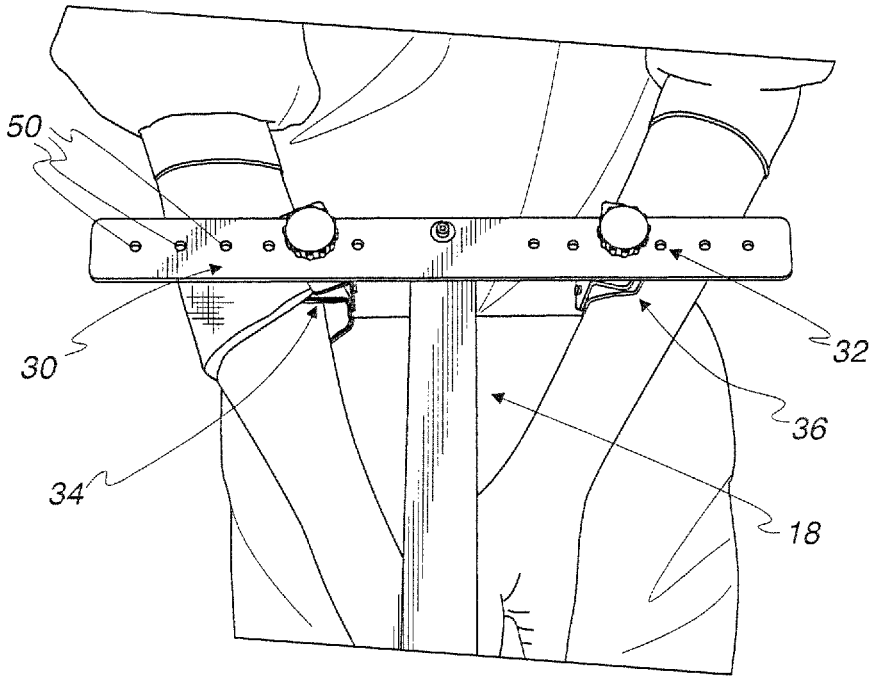
FIG. 5 is an enlarged, fragmentary view of the putting training apparatus operatively positioned as in FIG. 3.
Figure 6:
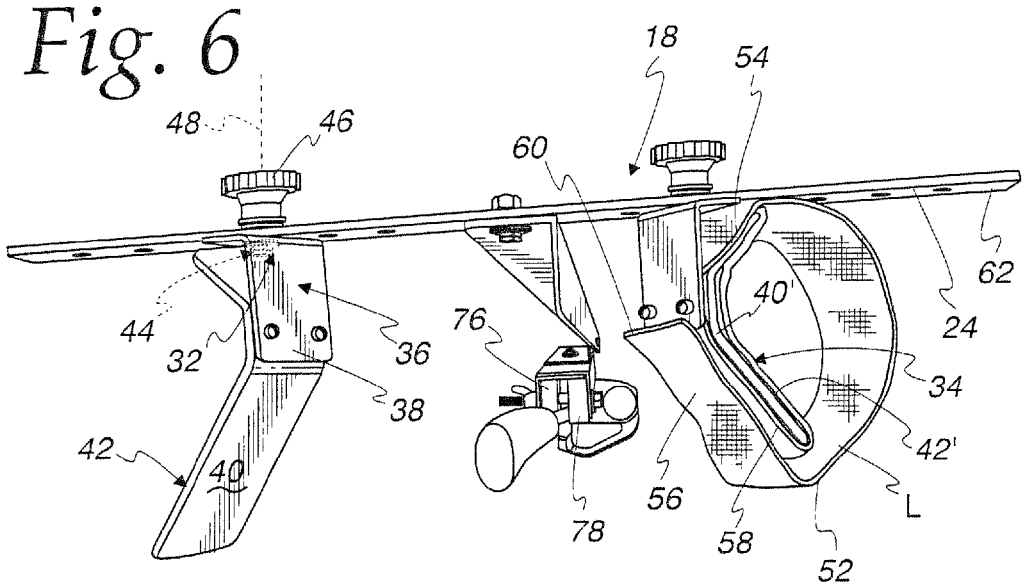
FIG. 6 is a bottom and rear perspective view of the putting training apparatus in FIGS. 3-5.
Figure 7:
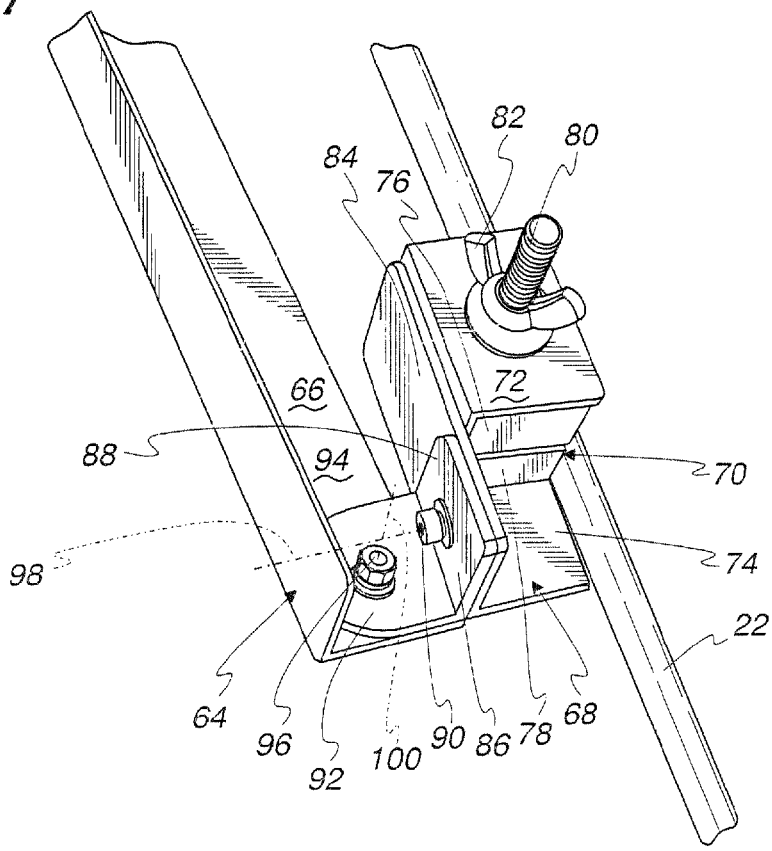
FIG. 7 is a fragmentary, bottom and side perspective view of the putting training apparatus in FIGS. 3-6.

The stabilizer assembly 18 consists of an elongate member 24 that continuously spans across a user's arms 26, 28 and defines spaced regions 30, 32 against which a user's arms can be placed with the putting training apparatus 10 operatively positioned and the user's arms 26, 28 situated as in FIGS. 3 and 5 to perform a putting stroke. At each of the regions 30, 32 there are spaced arm supports 34, 36, respectively, each of like construction to cooperate with its respective arm 26, 28 in like fashion.

The exemplary arm support 36 consists of an L-shaped mounting bracket 38 with a generally U-shaped piece 40 mounted thereon and defining a U-shaped seat 42 against which a user's arm can be placed with the user's arm situated to perform a putting stroke.

The combined mounting bracket 38 and arm support 36 are secured to the elongate member 24 through a threaded shaft 44 that projects through the elongate member 24 and is secured by a complementary threaded knob 46 that is configured to be hand operable. With the knob 46 loosened, the mounting bracket 38 and piece 40 can be turned together around an axis 48 of the shaft 44 to change the orientation of the U-shaped seat 42.

The elongate member 24 has a series of laterally spaced openings 50 to accept the shaft 44 to allow mounting of the combined mounting bracket 38 and piece 40 at different lateral locations.

As noted previously, the arm support 34 is mounted in similar fashion and has a corresponding piece 40' defining a U-shaped seat 42'.

The U-shaped seats 42, 42' open oppositely away from each other to allow the user's arms 26, 28 to be placed, one each, against the seats 42, 42' during a putting stroke.

As shown for exemplary arm support 34, an optional strap 52 is incorporated. The strap 52 has one end 54 fixed to the U-shaped piece 40' defining the seat 42'. The strap 52 can be manipulated to span the seat 42' to effectively define a closed loop with a variable diameter that is changed by controlling where a free end 56 thereof is secured to the piece 40'. Cooperating hook-and-loop fastener components 58, 60 may be provided on the piece 40' and strap end 56 to allow this selected securement to be effected.

With one of the arms in the loop L, additional bracing of the arm may be afforded by an underside surface 62 of the elongate member 24.

The elongate member 24 is connected to the putter shaft 22 through a vertical base 64 with an elongate component 66 that defines in conjunction with the elongate member 24 a "T" shape.

The elongate component 66, which defines a stem of the "T", is connected to the elongate putter shaft 22 through an adjustable mounting assembly 68. The mounting assembly 68 consists of a first subassembly 70 that captively engages the putter shaft 22. More specifically, the first subassembly 70 consists of spaced plates 72, 74 with associated compressible blocks 76, 78. A threaded bolt 80 extends through the plates 72, 74 and has a nut 82 threadably engaged therewith. Turning the nut 82 in a tightening direction draws the plates 72, 74 and associated blocks 76, 78 towards each other to thereby squeeze the putter shaft 22 captively therebetween. With this arrangement, the first subassembly 70 can be mounted selectively along the length of the putter shaft 22 and firmly engaged therewith so as to maintain a releasably fixed relationship without damaging the putter shaft 22 and whereby the putter head 16 has a fixed orientation on the frame.

The plate 74 has a transverse wall 84 that defines a support for an L-shaped bracket 86 that is used to connect between the elongate component 66 and first subassembly 70. One leg 88 of the bracket 86 is secured to the wall 84 through a threaded fastener 90, with the other leg 92 secured similarly to a flat wall 94 on the elongate component 66 through a threaded fastener 96.

The connection of the leg 88 to the wall 84 allows the bracket 86 and associated elongate component 66 to be relatively turned around the axis 98 of the fastener 90 and fixed in a desired position, as hereinafter explained. Similarly, the connection of the leg 92 to the wall 94 allows the elongate component 66 to be turned relative to the bracket 86, and thus the first subassembly 70, around the axis 100 of the fastener 96, thereby to change the angular relationship of the length of the elongate component 66 and that of the putter shaft 22.

With the depicted configuration, the arm supports 34, 36 can be mounted at locations along the elongate member 24 to select, and releasably maintain, a fixed relationship and spacing therebetween. As seen in FIG. 3, the angular orientation of the U-shaped seats 42, 42' can be matched to the angle of the arms 26, 28 converging towards the handle 14 with the handle gripped in a manner to perform a putting stroke.

The vertical spacing between the handle 14 and stabilizer assembly 18 can be selected by choosing a location at which the first subassembly 70 is releasably clamped to the elongate shaft 22.

The fasteners 90, 96 permit two additional dimensions of adjustment to allow adaptation of the entire mechanism to a particular user's height and desired stance at address during putting. The clamped connection of the first subassembly 70 to the putter shaft 22 also allows the putter shaft 22 to be turned around its axis 102 relative to the stabilizer assembly 18.

Initially, the training apparatus 10 is adjusted to the individual's body style and to match a preferred putting stance. All of the above adjustments are made so that a braced triangle is maintained by the user, as shown in FIG. 3, by the user's arms 26, 28 converging towards each other at the handle 14 and the user's torso at the front region, as traced by the line of the length of the elongate member 24 where the arm supports 34, 36 thereon are engaged with the forearm region of each of the user's arms 26, 28. With this arrangement, the user's wrists W become locked at the handle 14 and will be maintained locked as long as the aforementioned triangle is maintained through the putting stroke. The arms 26, 28 turn with the shoulders and are not restricted by the training apparatus 10, which essentially forces the user to consistently make a proper putting stroke.

Figure 8:
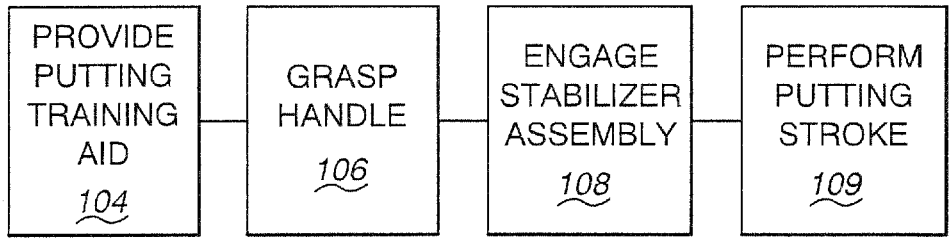
FIG. 8 is a schematic representation of a method of performing a putting stroke using a putting training apparatus according to the invention.

With the training apparatus as described above, a method of performing a putting stroke can be carried out as shown in flow diagram form in FIG. 8. As shown at block 104, a putting training apparatus, as described above, is provided. As shown at block 106, the handle 14 is grasped in a manner as one would typically do to perform a putting stroke. As shown at block 108, the stabilizer assembly 18 is engaged with the user's frontal region so that the stabilizer assembly 18 is borne against both of the user's arms 26, 28 to allow a braced triangle to be maintained by the user defined by: a) the user's arms 26, 28 converging towards each other at the handle 14; and b) the user's torso at the user's frontal region. As shown at block 109, through repositioning of the handle 14, the putter head 16 is repositioned to perform a putting stroke while maintaining the braced triangle.

Figure 9:
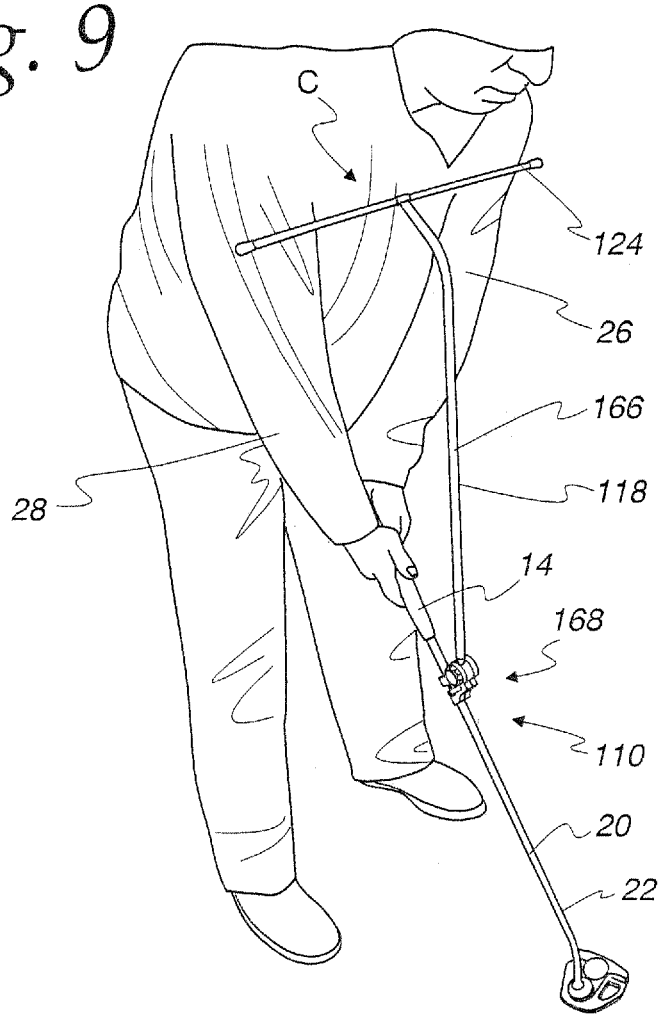
FIG. 9 is a perspective view of a modified form of putting training apparatus, according to the present invention, and operatively positioned with respect to a user for performing a putting stroke.
Figure 10:
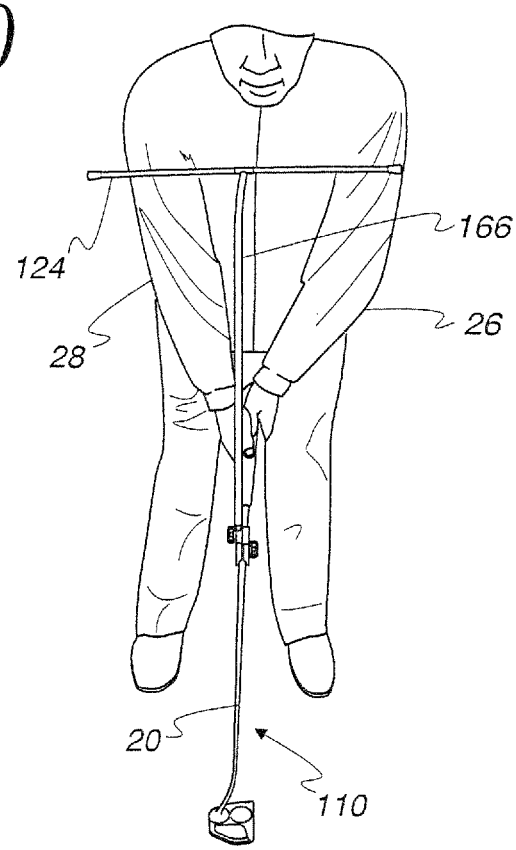
FIG. 10 is a front view of the putting training apparatus and user positioned as in FIG. 9.
Figure 11:
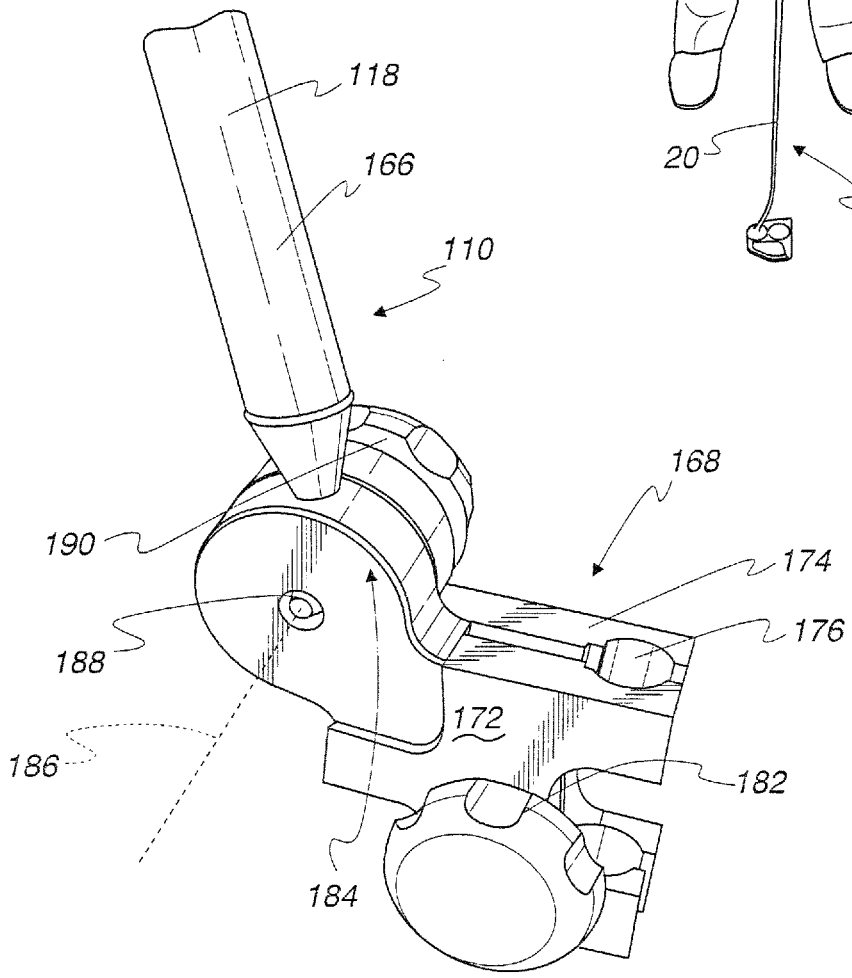
FIG. 11 is an enlarged, fragmentary, perspective view of a connection between a stabilizer assembly and putter on the putting training apparatus as shown in FIGS. 9 and 10.

A modified form of putting training apparatus is shown at 110 in FIGS. 9-11. The putting training apparatus 110 incorporates the aforementioned putter 20 and uses a modified form of stabilizer assembly 118 made from bendable bar stock.

More specifically, the stabilizer assembly 118 has an elongate member 124 that is in the form of a straight bar that is supported above the putter shaft 22 by an elongate component 166 that defines in conjunction with the elongate member 124 a similar "T" shape as produced by the elongate member 22 and elongate component 166 on the putting training apparatus 10. The elongate component 166 has a vertical extent such that the elongate member 124 spans, and is braced across, the user's arms at the upper regions thereof above the elbows. The elongate member 124 may actually be situated to contact the user's chest C between the arms 26, 28.

A mounting assembly 168 connects the elongate component 166 to the putter shaft 20 for multidimensional adjustment of the relationship between the handle 14 and stabilizer assembly 118.

As seen in FIG. 11, the mounting assembly 168 has spaced plates 172, 174 between which a receptacle 176 is defined for slidably receiving the putter shaft 22. A hand operable nut 182 is used to fix the mounting assembly 168 at the desired lengthwise location on the captive putter shaft 22.

The angular relationship of the elongate component 166 can be changed relative to the captive putter shaft 22 through a pivot connection at 184 that allows the elongate component 166 to be moved guidingly relative to the putter shaft 22 around an axis 186 defined by a threaded fastener 188 that can be tightened through a hand operable knob 190.

The training apparatus 110 is utilized as the training apparatus 10, with the exception that the user's arms 26, 28 are not captively held with respect to the training apparatus 10. However, the same rigid triangle is maintained, as shown at FIGS. 9 and 10, that stabilizes the wrists and maintains proper arm positioning through a putting stroke.

The foregoing disclosure of specific embodiments is intended to be illustrative of the broad concepts comprehended by the invention.

The invention claimed is:

1. A putting training apparatus comprising:

a frame, a golf putter having an elongate shaft with first and second ends spaced lengthwise of the shaft, a putter head at the first end and a gripping handle at the second end; and a stabilizer assembly on the frame that is engageable with a user's frontal region with the putting training apparatus operatively positioned to maintain a user's forearms braced consistently relative to each other and the gripping handle with the user's hands gripping the gripping handle in a manner to perform a putting stroke, wherein the putter head has a fixed orientation on the frame, wherein the stabilizer assembly comprises first and second arm supports that engage the user's forearms, an elongate member that extends between the first and second arm supports to fix the arm supports in a spaced relationship to each other, and an elongate component that connects to the elongate putter shaft at a location between the gripping handle and putter head in spaced relationship to the gripping handle and putter head, the elongate member and elongate component defining a "T" shape with a stem and a cross bar, the elongate component defining the stem and having a length greater than a length of the elongate member that defines the cross bar.

2. The putting training apparatus according to claim 1 wherein the first and second arm supports comprise first and second oppositely opening U-shaped seats against which a user's arms can be placed with the user's arms situated to perform a putting stroke.

3. The putting training apparatus according to claim 1 wherein the first arm support comprises a closed loop.

4. The putting training apparatus according to claim 3 wherein the closed loop has a selectively variable diameter.

5. The putting training apparatus according to claim 1 wherein the first and second arm supports have a selectively variable spacing, each from the other.

6. The putting training apparatus according to claim 1 wherein the golf putter and stabilizer assembly are interconnected so that a spacing between the handle and stabilizer assembly can be selectively changed.

7. The putting training apparatus according to claim 1 wherein the elongate shaft has an axis and the golf putter and stabilizer assembly are interconnected so that the elongate shaft can be turned around the elongate shaft axis relative to the stabilizer assembly.

8. The putting training apparatus according to claim 1 wherein the golf putter and stabilizer assembly are interconnected so that the stabilizer assembly can be turned guidingly relative to the golf putter around an axis.

9. The putting training apparatus according to claim 1 wherein the stabilizer assembly is configured to engage a user's forearms with the putting training apparatus operatively positioned.

10. The putting training apparatus according to claim 1 wherein the golf putter is connected to the stabilizer assembly so that the putter can be fixed in different positions relative to the stabilizer assembly, the different positions selected by changing one of: a) a vertical position of the putter head relative to the stabilizer assembly; and b) an angle of the putter shaft relative to the stabilizer assembly.

11. The putting training apparatus according to claim 1 wherein the stabilizer assembly is formed from bar stock.

12. The putting training apparatus according to claim 1 wherein no part of the putting training device extends upwardly from the user's forearm to above the user's elbows.

13. A method of performing a putting stroke comprising the steps of:

providing a putting training apparatus as in claim 1;

grasping the handle in a manner to perform a putting stroke;

engaging the stabilizer assembly with the user's frontal region so that the stabilizer assembly is borne against both of the user's arms to allow a braced triangle to be maintained by the user defined by: a) the user's arms converging towards each other at the handle; and b) the user's torso at the user's frontal region; and through the handle repositioning the putter head to perform a putting stroke while maintaining the braced triangle.

14. The method of performing a putting stroke according to claim 13 wherein the step of engaging the stabilizer assembly comprises engaging the stabilizer assembly with each of the user's forearms.

15. The method of performing a putting stroke according to claim 13 further comprising the step of changing a spacing between the handle and the stabilizer assembly.

16. The method of performing a putting stroke according to claim 13 further comprising the step of changing relative positions of the stabilizer assembly and putter head.

* * * * *